US008031129B2

(12) United States Patent
Shtrom et al.

(10) Patent No.: US 8,031,129 B2
(45) Date of Patent: Oct. 4, 2011

(54) DUAL BAND DUAL POLARIZATION ANTENNA ARRAY

(75) Inventors: Victor Shtrom, Los Altos, CA (US); William Kish, Saratoga, CA (US); Bernard Baron, Mountain View, CA (US)

(73) Assignee: Ruckus Wireless, Inc., Sunnyvale, CA (US)

( * ) Notice: Subject to any disclaimer, the term of this patent is extended or adjusted under 35 U.S.C. 154(b) by 0 days.

(21) Appl. No.: 12/605,256

(22) Filed: Oct. 23, 2009

(65) Prior Publication Data

US 2010/0103066 A1 Apr. 29, 2010

Related U.S. Application Data

(63) Continuation-in-part of application No. 12/396,439, filed on Mar. 2, 2009, now Pat. No. 7,880,683, which is a continuation of application No. 11/646,136, filed on Dec. 26, 2006, now Pat. No. 7,498,996, and a continuation-in-part of application No. 11/041,145, filed on Jan. 21, 2005, now Pat. No. 7,362,280.

(60) Provisional application No. 60/753,442, filed on Dec. 23, 2005, provisional application No. 60/602,711, filed on Aug. 18, 2004.

(51) Int. Cl.
*H01Q 21/00* (2006.01)

(52) U.S. Cl. ..... 343/893; 343/853

(58) Field of Classification Search ..... 343/700 MS, 343/795, 818, 853, 876, 893
See application file for complete search history.

(56) References Cited

U.S. PATENT DOCUMENTS

| | | | | |
|---|---|---|---|---|
| 723,188 | A | 3/1903 | Tesla | |
| 725,605 | A | 4/1903 | Tesla | |
| 1,869,659 | A | 8/1932 | Broertjes | |
| 2,292,387 | A | 8/1942 | Markey et al. | |
| 3,488,445 | A | 1/1970 | Chang | |
| 3,568,105 | A | 3/1971 | Felsenheld et al. | |
| 3,918,059 | A * | 11/1975 | Adrian | 342/16 |
| 3,922,685 | A | 11/1975 | Opas | |
| 3,967,067 | A | 6/1976 | Potter | |
| 3,982,214 | A | 9/1976 | Burns | |

(Continued)

FOREIGN PATENT DOCUMENTS

EP 352787 A2 1/1990

(Continued)

OTHER PUBLICATIONS

Tsunekawa, Kouichi, "Diversity Antennas for Portable Telephones," 39th IEEE Vehicular Technology Conference, pp. 50-56, vol. 1, Gateway to New Concepts in Vehicular Technology, May 1-3, 1989, San Francisco, CA.

(Continued)

*Primary Examiner* — Hoang V Nguyen
(74) *Attorney, Agent, or Firm* — Lewis and Roca LLP

(57) ABSTRACT

A wireless device having vertically and horizontally polarized antenna arrays can operate at multiple frequencies concurrently. A horizontally polarized antenna array allows for the efficient distribution of RF energy in dual bands using, for example, selectable antenna elements, reflectors and/or directors that create and influence a particular radiation pattern. A vertically polarized array can provide a high-gain dual band wireless environment using reflectors and directors as well. The polarized horizontal antenna arrays and polarized vertical antenna arrays can operate concurrently to provide dual band operation simultaneously.

11 Claims, 9 Drawing Sheets

U.S. PATENT DOCUMENTS

| | | | | |
|---|---|---|---|---|
| 3,991,273 | A | 11/1976 | Mathes | |
| 4,001,734 | A | 1/1977 | Burns | |
| 4,176,356 | A | 11/1979 | Foster et al. | |
| 4,193,077 | A | 3/1980 | Greenberg et al. | |
| 4,253,193 | A | 2/1981 | Kennard | |
| 4,305,052 | A | 12/1981 | Baril et al. | |
| 4,513,412 | A | 4/1985 | Cox | |
| 4,554,554 | A | 11/1985 | Olesen et al. | |
| 4,733,203 | A | 3/1988 | Ayasli | |
| 4,814,777 | A | 3/1989 | Monser | |
| 4,845,507 | A | 7/1989 | Archer et al. | |
| 5,063,574 | A | 11/1991 | Moose | |
| 5,097,484 | A | 3/1992 | Akaiwa | |
| 5,173,711 | A | 12/1992 | Takeuchi et al. | |
| 5,203,010 | A | 4/1993 | Felix | |
| 5,208,564 | A | 5/1993 | Burns et al. | |
| 5,220,340 | A | 6/1993 | Shafai | |
| 5,282,222 | A | 1/1994 | Fattouche et al. | |
| 5,291,289 | A | 3/1994 | Hulyalkar et al. | |
| 5,311,550 | A | 5/1994 | Fouche et al. | |
| 5,373,548 | A | 12/1994 | McCarthy | |
| 5,507,035 | A | 4/1996 | Bantz | |
| 5,532,708 | A | 7/1996 | Krenz et al. | |
| 5,559,800 | A | 9/1996 | Mousseau et al. | |
| 5,610,617 | A | 3/1997 | Gans et al. | |
| 5,629,713 | A * | 5/1997 | Mailandt et al. | 343/808 |
| 5,754,145 | A | 5/1998 | Evans | |
| 5,767,755 | A | 6/1998 | Kim et al. | |
| 5,767,809 | A | 6/1998 | Chuang et al. | |
| 5,786,793 | A | 7/1998 | Maeda et al. | |
| 5,802,312 | A | 9/1998 | Lazaridis et al. | |
| 5,964,830 | A | 10/1999 | Durrett | |
| 5,990,838 | A | 11/1999 | Burns et al. | |
| 6,006,075 | A | 12/1999 | Smith et al. | |
| 6,011,450 | A | 1/2000 | Miya | |
| 6,018,644 | A | 1/2000 | Minarik | |
| 6,031,503 | A | 2/2000 | Preiss, II et al. | |
| 6,034,638 | A | 3/2000 | Thiel et al. | |
| 6,052,093 | A | 4/2000 | Yao et al. | |
| 6,091,364 | A | 7/2000 | Murakami et al. | |
| 6,094,177 | A | 7/2000 | Yamamoto | |
| 6,097,347 | A | 8/2000 | Duan et al. | |
| 6,101,397 | A * | 8/2000 | Grob et al. | 455/557 |
| 6,104,356 | A | 8/2000 | Hikuma et al. | |
| 6,169,523 | B1 | 1/2001 | Ploussios | |
| 6,266,528 | B1 | 7/2001 | Farzaneh | |
| 6,292,153 | B1 | 9/2001 | Aiello et al. | |
| 6,307,524 | B1 | 10/2001 | Britain | |
| 6,317,599 | B1 | 11/2001 | Rappaport et al. | |
| 6,323,810 | B1 | 11/2001 | Poilasne et al. | |
| 6,326,922 | B1 | 12/2001 | Hegendoerfer | |
| 6,337,628 | B2 | 1/2002 | Campana et al. | |
| 6,337,668 | B1 | 1/2002 | Ito et al. | |
| 6,339,404 | B1 | 1/2002 | Johnson et al. | |
| 6,345,043 | B1 | 2/2002 | Hsu | |
| 6,356,242 | B1 | 3/2002 | Ploussios | |
| 6,356,243 | B1 | 3/2002 | Schneider et al. | |
| 6,356,905 | B1 | 3/2002 | Gershman et al. | |
| 6,377,227 | B1 | 4/2002 | Zhu et al. | |
| 6,392,610 | B1 | 5/2002 | Braun et al. | |
| 6,404,386 | B1 | 6/2002 | Proctor, Jr. et al. | |
| 6,407,719 | B1 | 6/2002 | Ohira et al. | |
| RE37,802 | E | 7/2002 | Fattouche et al. | |
| 6,414,647 | B1 | 7/2002 | Lee | |
| 6,424,311 | B1 | 7/2002 | Tsai et al. | |
| 6,442,507 | B1 | 8/2002 | Skidmore et al. | |
| 6,445,688 | B1 | 9/2002 | Garces et al. | |
| 6,456,242 | B1 | 9/2002 | Crawford | |
| 6,493,679 | B1 | 12/2002 | Rappaport et al. | |
| 6,496,083 | B1 | 12/2002 | Kushitani et al. | |
| 6,498,589 | B1 | 12/2002 | Horii | |
| 6,499,006 | B1 | 12/2002 | Rappaport et al. | |
| 6,507,321 | B2 | 1/2003 | Oberschmidt et al. | |
| 6,531,985 | B1 | 3/2003 | Jones et al. | |
| 6,583,765 | B1 | 6/2003 | Schamberger et al. | |
| 6,586,786 | B2 | 7/2003 | Kitazawa et al. | |
| 6,611,230 | B2 | 8/2003 | Phelan | |
| 6,621,464 | B1 | 9/2003 | Fang | |
| 6,625,454 | B1 | 9/2003 | Rappaport et al. | |
| 6,633,206 | B1 | 10/2003 | Kato | |
| 6,642,889 | B1 | 11/2003 | McGrath | |
| 6,674,459 | B2 | 1/2004 | Ben-Shachar et al. | |
| 6,701,522 | B1 | 3/2004 | Rubin et al. | |
| 6,724,346 | B2 | 4/2004 | Le Bolzer | |
| 6,725,281 | B1 | 4/2004 | Zintel et al. | |
| 6,741,219 | B2 | 5/2004 | Shor | |
| 6,747,605 | B2 | 6/2004 | Lebaric | |
| 6,753,814 | B2 | 6/2004 | Killen et al. | |
| 6,762,723 | B2 | 7/2004 | Nallo et al. | |
| 6,774,846 | B2 | 8/2004 | Fullerton et al. | |
| 6,779,004 | B1 | 8/2004 | Zintel | |
| 6,819,287 | B2 | 11/2004 | Sullivan et al. | |
| 6,839,038 | B2 | 1/2005 | Weinstein | |
| 6,859,176 | B2 | 2/2005 | Choi | |
| 6,859,182 | B2 | 2/2005 | Horii | |
| 6,876,280 | B2 | 4/2005 | Nakano | |
| 6,876,836 | B2 | 4/2005 | Lin et al. | |
| 6,888,504 | B2 | 5/2005 | Chiang et al. | |
| 6,888,893 | B2 | 5/2005 | Li et al. | |
| 6,892,230 | B1 | 5/2005 | Gu et al. | |
| 6,903,686 | B2 | 6/2005 | Vance et al. | |
| 6,906,678 | B2 | 6/2005 | Chen | |
| 6,910,068 | B2 | 6/2005 | Zintel et al. | |
| 6,914,581 | B1 | 7/2005 | Popek | |
| 6,924,768 | B2 | 8/2005 | Wu et al. | |
| 6,931,429 | B2 | 8/2005 | Gouge et al. | |
| 6,941,143 | B2 | 9/2005 | Mathur | |
| 6,943,749 | B2 | 9/2005 | Paun | |
| 6,950,019 | B2 | 9/2005 | Bellone et al. | |
| 6,950,069 | B2 | 9/2005 | Gaucher et al. | |
| 6,961,026 | B2 | 11/2005 | Toda | |
| 6,961,028 | B2 | 11/2005 | Joy et al. | |
| 6,965,353 | B2 | 11/2005 | Shirosaka et al. | |
| 6,973,622 | B1 | 12/2005 | Rappaport et al. | |
| 6,975,834 | B1 | 12/2005 | Forster | |
| 6,980,782 | B1 | 12/2005 | Braun et al. | |
| 7,023,909 | B1 | 4/2006 | Adams et al. | |
| 7,034,769 | B2 | 4/2006 | Surducan et al. | |
| 7,034,770 | B2 | 4/2006 | Yang et al. | |
| 7,039,363 | B1 | 5/2006 | Kasapi et al. | |
| 7,043,277 | B1 | 5/2006 | Pfister | |
| 7,050,809 | B2 | 5/2006 | Lim | |
| 7,053,844 | B2 | 5/2006 | Gaucher et al. | |
| 7,064,717 | B2 | 6/2006 | Kaluzni et al. | |
| 7,075,485 | B2 | 7/2006 | Song et al. | |
| 7,085,814 | B1 | 8/2006 | Ghandhi et al. | |
| 7,088,299 | B2 | 8/2006 | Siegler et al. | |
| 7,089,307 | B2 | 8/2006 | Zintel et al. | |
| 7,130,895 | B2 | 10/2006 | Zintel et al. | |
| 7,171,475 | B2 | 1/2007 | Weisman et al. | |
| 7,277,063 | B2 | 10/2007 | Shirosaka et al. | |
| 7,312,762 | B2 | 12/2007 | Puente Ballarda et al. | |
| 7,319,432 | B2 | 1/2008 | Andersson | |
| 2001/0046848 | A1 | 11/2001 | Kenkel | |
| 2002/0031130 | A1 | 3/2002 | Tsuchiya et al. | |
| 2002/0047800 | A1 | 4/2002 | Proctor, Jr. et al. | |
| 2002/0054580 | A1 | 5/2002 | Strich et al. | |
| 2002/0080767 | A1 | 6/2002 | Lee | |
| 2002/0084942 | A1 | 7/2002 | Tsai et al. | |
| 2002/0101377 | A1 | 8/2002 | Crawford | |
| 2002/0105471 | A1 | 8/2002 | Kojima et al. | |
| 2002/0112058 | A1 | 8/2002 | Weisman et al. | |
| 2002/0158798 | A1 | 10/2002 | Chiang et al. | |
| 2002/0170064 | A1 | 11/2002 | Monroe et al. | |
| 2003/0026240 | A1 | 2/2003 | Eyuboglu et al. | |
| 2003/0030588 | A1 | 2/2003 | Kalis et al. | |
| 2003/0063591 | A1 | 4/2003 | Leung et al. | |
| 2003/0122714 | A1 | 7/2003 | Wannagot et al. | |
| 2003/0169330 | A1 | 9/2003 | Ben-Shachar et al. | |
| 2003/0184490 | A1 | 10/2003 | Raiman et al. | |
| 2003/0189514 | A1 | 10/2003 | Miyano et al. | |
| 2003/0189521 | A1 | 10/2003 | Yamamoto et al. | |
| 2003/0189523 | A1 | 10/2003 | Ojantakanen et al. | |
| 2003/0210207 | A1 | 11/2003 | Suh et al. | |
| 2003/0227414 | A1 | 12/2003 | Saliga et al. | |
| 2004/0014432 | A1 | 1/2004 | Boyle | |
| 2004/0017310 | A1 | 1/2004 | Runkle et al. | |

| | | | |
|---|---|---|---|
| 2004/0017860 | A1 | 1/2004 | Liu |
| 2004/0027291 | A1 | 2/2004 | Zhang et al. |
| 2004/0027304 | A1 | 2/2004 | Chiang et al. |
| 2004/0032378 | A1 | 2/2004 | Volman et al. |
| 2004/0036651 | A1 | 2/2004 | Toda |
| 2004/0036654 | A1* | 2/2004 | Hsieh ..... 343/702 |
| 2004/0041732 | A1 | 3/2004 | Aikawa et al. |
| 2004/0048593 | A1 | 3/2004 | Sano |
| 2004/0058690 | A1 | 3/2004 | Ratzel et al. |
| 2004/0061653 | A1 | 4/2004 | Webb et al. |
| 2004/0070543 | A1 | 4/2004 | Masaki |
| 2004/0080455 | A1 | 4/2004 | Lee |
| 2004/0095278 | A1 | 5/2004 | Kanemoto et al. |
| 2004/0114535 | A1 | 6/2004 | Hoffmann et al. |
| 2004/0125777 | A1 | 7/2004 | Doyle et al. |
| 2004/0145528 | A1 | 7/2004 | Mukai et al. |
| 2004/0160376 | A1 | 8/2004 | Hornsby et al. |
| 2004/0190477 | A1 | 9/2004 | Olson et al. |
| 2004/0203347 | A1 | 10/2004 | Nguyen |
| 2004/0260800 | A1 | 12/2004 | Gu et al. |
| 2005/0022210 | A1 | 1/2005 | Zintel et al. |
| 2005/0041739 | A1 | 2/2005 | Li et al. |
| 2005/0042988 | A1 | 2/2005 | Hoek et al. |
| 2005/0048934 | A1 | 3/2005 | Rawnick et al. |
| 2005/0074018 | A1 | 4/2005 | Zintel et al. |
| 2005/0097503 | A1 | 5/2005 | Zintel et al. |
| 2005/0105632 | A1 | 5/2005 | Catreux-Erces et al. |
| 2005/0128983 | A1 | 6/2005 | Kim et al. |
| 2005/0135480 | A1 | 6/2005 | Li et al. |
| 2005/0138137 | A1 | 6/2005 | Encarnacion et al. |
| 2005/0138193 | A1 | 6/2005 | Encarnacion et al. |
| 2005/0146475 | A1 | 7/2005 | Bettner et al. |
| 2005/0180381 | A1 | 8/2005 | Retzer et al. |
| 2005/0188193 | A1 | 8/2005 | Kuehnel et al. |
| 2005/0240665 | A1 | 10/2005 | Gu et al. |
| 2005/0267935 | A1 | 12/2005 | Ghandhi et al. |
| 2006/0007891 | A1 | 1/2006 | Aoki et al. |
| 2006/0094371 | A1 | 5/2006 | Nguyen |
| 2006/0098607 | A1 | 5/2006 | Zeng et al. |
| 2006/0123124 | A1 | 6/2006 | Weisman et al. |
| 2006/0123125 | A1 | 6/2006 | Weisman et al. |
| 2006/0123455 | A1 | 6/2006 | Pai et al. |
| 2006/0168159 | A1 | 7/2006 | Weisman et al. |
| 2006/0184660 | A1 | 8/2006 | Rao et al. |
| 2006/0184661 | A1 | 8/2006 | Weisman et al. |
| 2006/0184693 | A1 | 8/2006 | Rao et al. |
| 2006/0224690 | A1 | 10/2006 | Falkenburg et al. |
| 2006/0225107 | A1 | 10/2006 | Seetharaman et al. |
| 2006/0227761 | A1 | 10/2006 | Scott, III et al. |
| 2006/0239369 | A1 | 10/2006 | Lee |
| 2006/0262015 | A1 | 11/2006 | Thornell-Pers et al. |
| 2006/0291434 | A1 | 12/2006 | Gu et al. |
| 2007/0027622 | A1 | 2/2007 | Cleron et al. |
| 2007/0135167 | A1 | 6/2007 | Liu |

FOREIGN PATENT DOCUMENTS

| | | | |
|---|---|---|---|
| EP | 0 534 612 | | 3/1993 |
| EP | 0756381 | A2 | 1/1997 |
| EP | 1152543 | A1 | 11/2001 |
| EP | 1 376 920 | | 6/2002 |
| EP | 1220461 | A2 | 7/2002 |
| EP | 1 315 311 | | 5/2003 |
| EP | 1 450 521 | | 8/2004 |
| EP | 1 608 108 | | 12/2005 |
| JP | 03038933 | | 2/1991 |
| JP | 2008/088633 | | 2/1996 |
| JP | 2001/057560 | | 2/2002 |
| JP | 2005/354249 | | 12/2005 |
| JP | 2006/060408 | | 3/2006 |
| WO | WO 90/04893 | | 5/1990 |
| WO | WO 02/025967 | | 3/2002 |
| WO | WO 03/079484 | | 9/2003 |
| WO | W02006023247 | A1 | 3/2006 |

OTHER PUBLICATIONS

Supplementary European Search Report for foreign application No. EP07755519 dated Mar. 11, 2009.

Ando et al., "Study of Dual-Polarized Omni-Directional Antennas for 5.2 GHz-Band 2x2 MIMO-OFDM Systems," Antennas and Propagation Society International Symposium, 2004, IEEE, pp. 1740-1743, vol. 2.

Bedell, Paul, "Wireless Crash Course," 2005, p. 84, The McGraw-Hill Companies, Inc., USA.

Petition Decision Denying Request to Order Additional Claims for U.S. Patent No. 7,193,562 (Control No. 95/001078) mailed on Jul. 10, 2009.

Right of Appeal Notice for U.S. Patent No. 7,193,562 (Control No. 95/001078) mailed on Jul. 10, 2009.

Chuang et al., "A 2.4 GHz Polarization-diversity Planar Printed Diopoe Antenna for WLAN and Wireless Communication Applications," Microwave Journal, vol. 45, No. 6, pp. 50-62, Jun. 2002.

Frederick et al., Smart Antennas Based on Spatial Multiplexing of Local Elements (SMILE) for Mutual Coupling Reduction, IEEE Transactions of Antennas and Propagation, vol. 52, No. 1, pp. 106-114, Jan. 2004.

W. E. Doherty, Jr. et al., "The Pin Diode Circuit Designer's Handbook," 1998.

Varnes et al., "A Switched Radial Divider for an L-Band Mobile Satellite Antenna," European Microwave Conference, Oct. 1995, pp. 1037-1041.

English Translation of PCT Pub. No. WO2004/051798 (as filed US National Stage U.S. Appl. No. 10/536,547).

Behdad et al., "Slot Antenna Miniaturization Using Distributed Inductive Loading," Antenna and Propagation Society International Symposium, 2003 IEEE, vol. 1, pp. 308-311, Jun. 2003.

Press Release, "NETGEAR RangeMax(TM) Wireless Solutions Incorporate Smart MIMO Technology to Eliminate Wireless Dead Spots and Take Consumers Farther," Ruckus Wireless, Inc., Mar. 7, 2005. Available at: http://ruckuswireless.com/press/releases/20050307.php.

"Authorization of Spread Spectrum Systems Under Parts 15 and 90 of the FCC Rules and Regulations," Rules and Regulations Federal Communications Commission, 47 CFR Part 2, 15, and 90, Jun. 18, 1985.

"Authorization of spread spectrum and other wideband emissions not presently provided for in the FCC Rules and Regulations," Before the Federal Communications Commission, FCC 81-289, 87 F.C.C.2d 876, Gen Docket No. 81-413, Jun. 30, 1981.

RL Miller, "4.3 Project X—A True Secrecy System for Speech," Engineering and Science in the Bell System, A History of Engineering and Science in the Bell System National Service in War and Peace (1925-1975), pp. 296-317, 1978, Bell Telephone Laboratories, Inc.

Chang, Robert W., "Synthesis of Band-Limited Orthogonal Signals for Multichannel Data Transmission," The Bell System Technical Journal, Dec. 1966, pp. 1775-1796.

Cimini, Jr., Leonard J., "Analysis and Simulation of a Digital Mobile Channel Using Orthogonal Frequency Division Multiplexing," IEEE Transactions on Communications, vol. Com-33, No. 7, Jul. 1985, pp. 665-675.

Saltzberg, Burton R., "Performance of an Efficient Parallel Data Transmission System," IEEE Transactions on Communication Technology, vol. Com-15, No. 6., Dec. 1967, pp. 805-811.

Weinstein, S.B., et al., "Data Transmission by Frequency-Division Multiplexing Using Discrete Fourier Transform," IEEE Transactions on Communication Technology, vol. Com-19, No. 5, Oct. 1971, pp. 628-634.

Moose, Paul H., "Differential Modulation and Demodulation of Multi-Frequency Digital Communications Signals," 1990 IEEE, CH2831-6/90/0000-0273.

Casas, Eduardo F., et al., "OFDM for Data Communication Over Mobile Radio FM Channels-Part I: Analysis and Experimental Results," IEEE Transactions on Communications, vol. 39, No. 5., May 1991, pp. 783-793.

Casas, Eduardo F., et al., "OFDM for Data Communication Over Mobile Radio FM Channels-Part II: Performance Improvement," Department of Electrical Engineering, University of British Columbia.

Chang, Robert W., et al., "A Theoretical Study of Performance of an Orthogonal Multiplexing Data Transmission Scheme," IEEE Transactions on Communication Technology, vol. Com-16, No. 4, Aug. 1968, pp. 529-540.
Gledhill, J. J., et al., "The Transmission of Digital Television in the UHF Band Using Orthogonal Frequency Division Multiplexing," Sixth International Conference on Digital Processing of Signals in Communications, Sep. 2-6, 1991, pp. 175-180.
Alard, M., et al., "Principles of Modulation and Channel Coding for Digital Broadcasting for Mobile Receivers," 8301 EBU Review Technical, Aug. 1987, No. 224, Brussels, Belgium.
Berenguer, Inaki, et al., "Adaptive MIMO Antenna Selection," Nov. 2003.
Gaur, Sudhanshu, et al., "Transmit/Receive Antenna Selection for MIMO Systems to Improve Error Performance of Linear Receivers," School of ECE, Georgia Institute of Technology, Apr. 4, 2005.
Sadek, Mirette, et al., "Active Antenna Selection in Multiuser MIMO Communications," IEEE Transactions on Signal Processing, vol. 55, No. 4, Apr. 2007, pp. 1498-1510.
Molisch, Andreas F., et al., "MIMO Systems with Antenna Selection-an Overview," Draft, Dec. 31, 2003.
Tang, Ken, et al., "MAC Layer Broadcast Support in 802.11 Wireless Networks," Computer Science Department, University of California, Los Angeles, 2000 IEEE, pp. 544-548.
Tang, Ken, et al., "MAC Reliable Broadcast in Ad Hoc Networks," Computer Science Department, University of California, Los Angeles, 2001 IEEE, pp. 1008-1013.
Park, Vincent D., et al., "A Performance Comparison of the Temporally-Ordered Routing Algorithm and Ideal Link-State Routing," IEEE, Jul. 1998, pp. 592-598.
Akyildiz, Ian F., et al., "A Virtual Topology Based Routing Protocol for Multihop Dynamic Wireless Networks," Broadband and Wireless Networking Lab, School of Electrical and Computer Engineering, Georgia Institute of Technology.
Dell Inc., "How Much Broadcast and Multicast Traffic Should I Allow in my Network," PowerConnect Application Note #5, Nov. 2003.
Toskala, Antti, "Enhancement of Broadcast and Introduction of Multicast Capabilities in RAN," Nokia Networks, Palm Springs, California, Mar. 13-16, 2001.
Microsoft Corporation, "IEEE 802.11 Networks and Windows XP," Windows Hardware Developer Central, Dec. 4, 2001.
Festag, Andreas, "What is MOMBASA?" Telecommunication Networks Group (TKN), Technical University of Berlin, Mar. 7, 2002.
Hewlett Packard, "HP ProCurve Networking: Enterprise Wireless LAN Networking and Mobility Solutions," 2003.
Dutta, Ashutosh, et al., "MarconiNet Supporting Streaming Media Over Localized Wireless Multicast," Proc. of the 2d Int'l Workshop on Mobile Commerce, 2002.
Dunkels, Adam, et al., "Making TCP/IP Viable for Wireless Sensor Networks," Proc. of the 1st Euro. Workshop on Wireless Sensor Networks, Berlin, Jan. 2004.
Dunkels, Adam, et al., "Connecting Wireless Sensornets with TCP/IP Networks," Proc. of the 2nd Int'l Conf. on Wired Networks, Frankfurt, Feb. 2004.
Cisco Systems, "Cisco Aironet Access Point Software Configuration Guide: Configuring Filters and Quality of Service," Aug. 2003.
Hirayama, Koji, et al., "Next Generation Mobile-Access IP Network" Hitachi Review, vol. 49, No. 4, 2000.
Calhoun, Pat, et al., "802.11r strengthens wireless voice," Technology Update, Network World, Aug. 22, 2005. http://www.networkworld.com/news/tech/2005/082208techupdate.html.
Alimian, Areg, et al., "Analysis of Roaming Techniques," doc.:IEEE 802.11-04/0377r1, Submission, Mar. 2004.
Information Society Technologies Ultrawaves, "System Concept / Architecture Design and Communcation Stack Requirement Document," Feb. 23, 2004.
Golmie, Nada, "Coexistence in Wireless Networks: Challenges and System-Level Solutions in the Unlicensed Bands," Cambridge University Press, 2006.
Mawa, Rakesh, "Power Control in 3G Systems," Hughes Systique Corporation, Jun. 28, 2006.
Wennstrom, Mattias, et al., "Transmit Antenna Diversity in Ricean Fading MIMO Channels with Co-Channel Interference," 2001.
Steger, Christopher, et al., "Performance of IEEE 802.11b Wireless LAN in an Emulated Mobile Channel," 2003.
Chang, Nicholas B., et al., "Optimal Channel Probing and Transmission Scheduling for Opportunistics Spectrum Access" Sep. 2007.

* cited by examiner

DUAL BAND DUAL POLARIZATION ANTENNA ARRAY

CROSS-REFERENCE TO RELATED APPLICATION

The present application is a continuation in part and claims the priority benefit of U.S. patent application Ser. No. 12/396,439 filed Mar. 2, 2009 now U.S. Pat. No. 7,880,683, which is a continuation and claims the priority benefit of U.S. patent application Ser. No. 11/646,136 filed Dec. 26, 2006 and now U.S. Pat. No. 7,498,996, which claims the priority benefit of U.S. provisional application 60/753,442 filed Dec. 23, 2005; U.S. patent application Ser. No. 11/646,136 is also a continuation in part and claims the priority benefit of U.S. patent application Ser. No. 11/041,145 filed Jan. 21, 2005 and now U.S. Pat. No. 7,362,280, which claims the priority benefit of U.S. provisional application No. 60/602,711 filed Aug. 18, 2004. The disclosure of each of the aforementioned applications is incorporated herein by reference.

BACKGROUND OF THE INVENTION

1. Field of the Invention

The present invention generally relates to wireless communications. More specifically, the present invention relates to dual band antenna arrays.

2. Description of the Related Art

In wireless communications systems, there is an ever-increasing demand for higher data throughput and reduced interference that can disrupt data communications. A wireless link in an Institute of Electrical and Electronic Engineers (IEEE) 802.11 network can be susceptible to interference from other access points and stations, other radio transmitting devices, and changes or disturbances in the wireless link environment between an access point and remote receiving node. The interference may degrade the wireless link thereby forcing communication at a lower data rate. The interference may, in some instances, be sufficiently strong as to disrupt the wireless link altogether.

FIG. 1 is a block diagram of a wireless device 100 in communication with one or more remote devices and as is generally known in the art. While not shown, the wireless device 100 of FIG. 1 includes antenna elements and a radio frequency (RF) transmitter and/or a receiver, which may operate using the 802.11 protocol. The wireless device 100 of FIG. 1 can be encompassed in a set-top box, a laptop computer, a television, a Personal Computer Memory Card International Association (PCMCIA) card, a remote control, a mobile telephone or smart phone, a handheld gaming device, a remote terminal, or other mobile device.

In one particular example, the wireless device 100 can be a handheld device that receives input through an input mechanism configured to be used by a user. The wireless device 100 may process the input and generate a corresponding RF signal. The generated RF signal may then be transmitted to one or more receiving nodes 110-140 via wireless links. Nodes 120-140 may receive data, transmit data, or transmit and receive data (i.e., a transceiver).

Wireless device 100 may also be an access point for communicating with one or more remote receiving nodes over a wireless link as might occur in an 802.11 wireless network. The wireless device 100 may receive data as a part of a data signal from a router connected to the Internet (not shown) or a wired network. The wireless device 100 may then convert and wirelessly transmit the data to one or more remote receiving nodes (e.g., receiving nodes 110-140). The wireless device 100 may also receive a wireless transmission of data from one or more of nodes 110-140, convert the received data, and allow for transmission of that converted data over the Internet via the aforementioned router or some other wired device. The wireless device 100 may also form a part of a wireless local area network (LAN) that allows for communications among two or more of nodes 110-140.

For example, node 110 can be a mobile device with WiFi capability. Node 110 (mobile device) may communicate with node 120, which can be a laptop computer including a WiFi card or wireless chipset. Communications by and between node 110 and node 120 can be routed through the wireless device 100, which creates the wireless LAN environment through the emission of RF and 802.11 compliant signals.

Receiving nodes 105-120 can be different types of devices which are configured to communicate at different frequencies. Receiving node 105 may operate at a first frequency or band and receiving node 110 may operate on a second frequency. Current wireless devices may include omnidirectional antennas that are vertically and horizontally polarized in a single band, but do not operate as omnidirectional in multiple bands. What is needed is a wireless device that includes omnidirectional and multi-polarization antennas which operates in dual band.

SUMMARY OF THE PRESENTLY CLAIMED INVENTION

The present invention may include a wireless device having vertically and horizontally polarized antenna arrays, which concurrently operate at multiple frequencies. A horizontally polarized antenna array allows for the efficient distribution of RF energy in dual bands into a communications environment. The horizontally polarized antenna array may use selectable antenna elements, reflectors and/or directors that create and influence a particular radiation pattern (e.g., a substantially omnidirectional radiation pattern). A vertically polarized array can provide a high-gain dual band wireless environment such that one wireless environment does not interfere with other nearby wireless environments (e.g., between floors of an office building) and, further, avoids interference created by the other environments.

A first embodiment of an antenna system includes a horizontally polarized antenna array, a vertically polarized antenna array and a radio modulator/demodulator. The horizontally polarized antenna array can be configured to operate at a first frequency and a second frequency concurrently. The vertically polarized antenna array can be coupled to the horizontally polarized antenna array and configured to operate at the first frequency and the second frequency concurrently with the horizontally polarized antenna array. The radio modulator/demodulator can be configured to communicate a radio frequency signal with the horizontally polarized antenna array and vertically polarized antenna array.

DETAILED DESCRIPTION

Embodiments of the present invention allow for the use of wireless device having vertically and horizontally polarized antenna arrays, which concurrently operate at multiple frequencies. A horizontally polarized antenna array allows for the efficient distribution of RF energy in dual bands into a communications environment using, for example, selectable antenna elements, reflectors and/or directors that create and influence a particular radiation pattern (e.g., a substantially omnidirectional radiation pattern). A vertically polarized array can provide a high-gain dual band wireless environment such that one wireless environment does not interfere with other nearby wireless environments (e.g., between floors of an office building) and, further, avoids interference created by the other environments.

Figure 1:
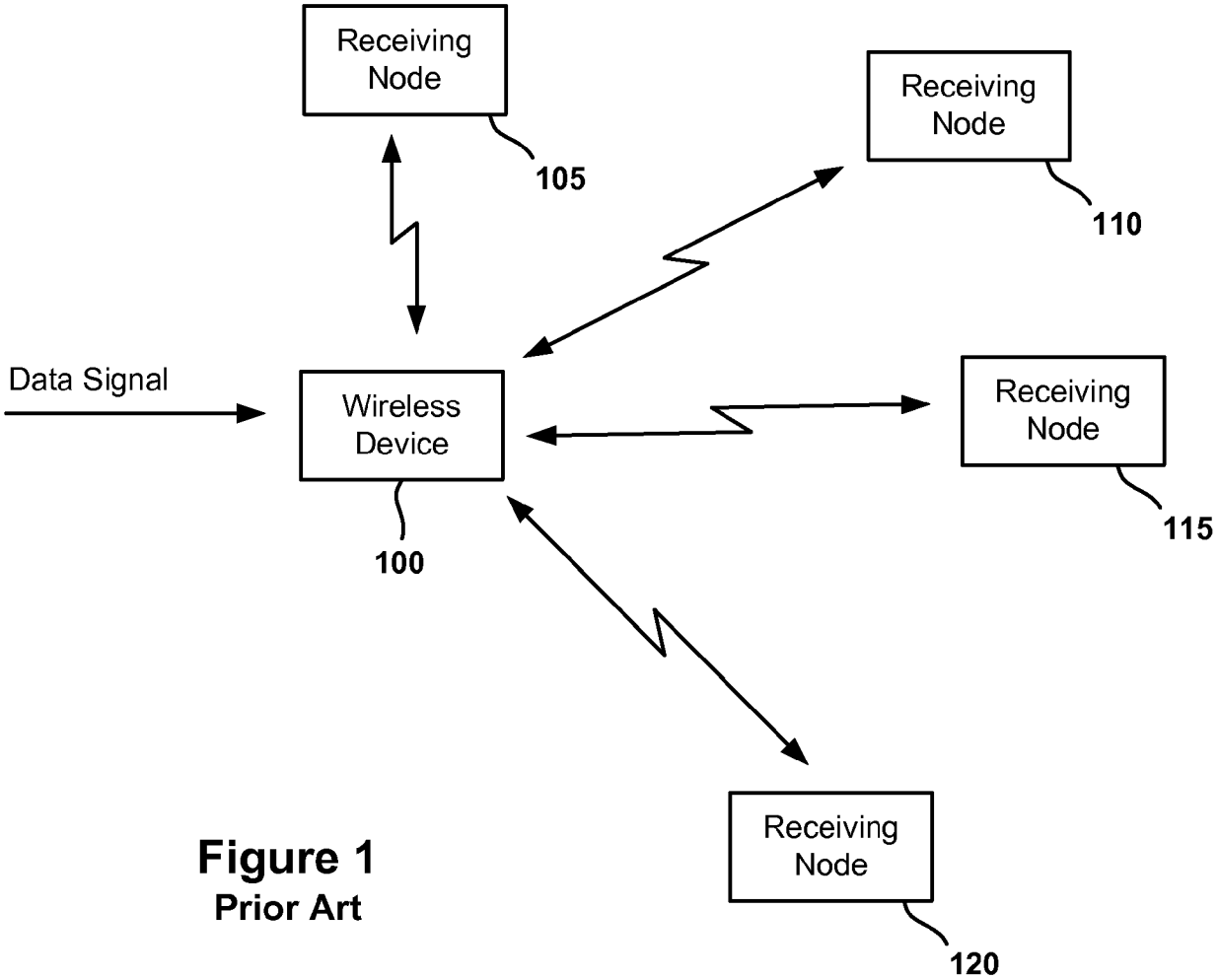
Figure 1 Prior Art
FIG. 1 is a block diagram of a wireless device in communication with one or more remote devices as known in the art.
Figure 2:
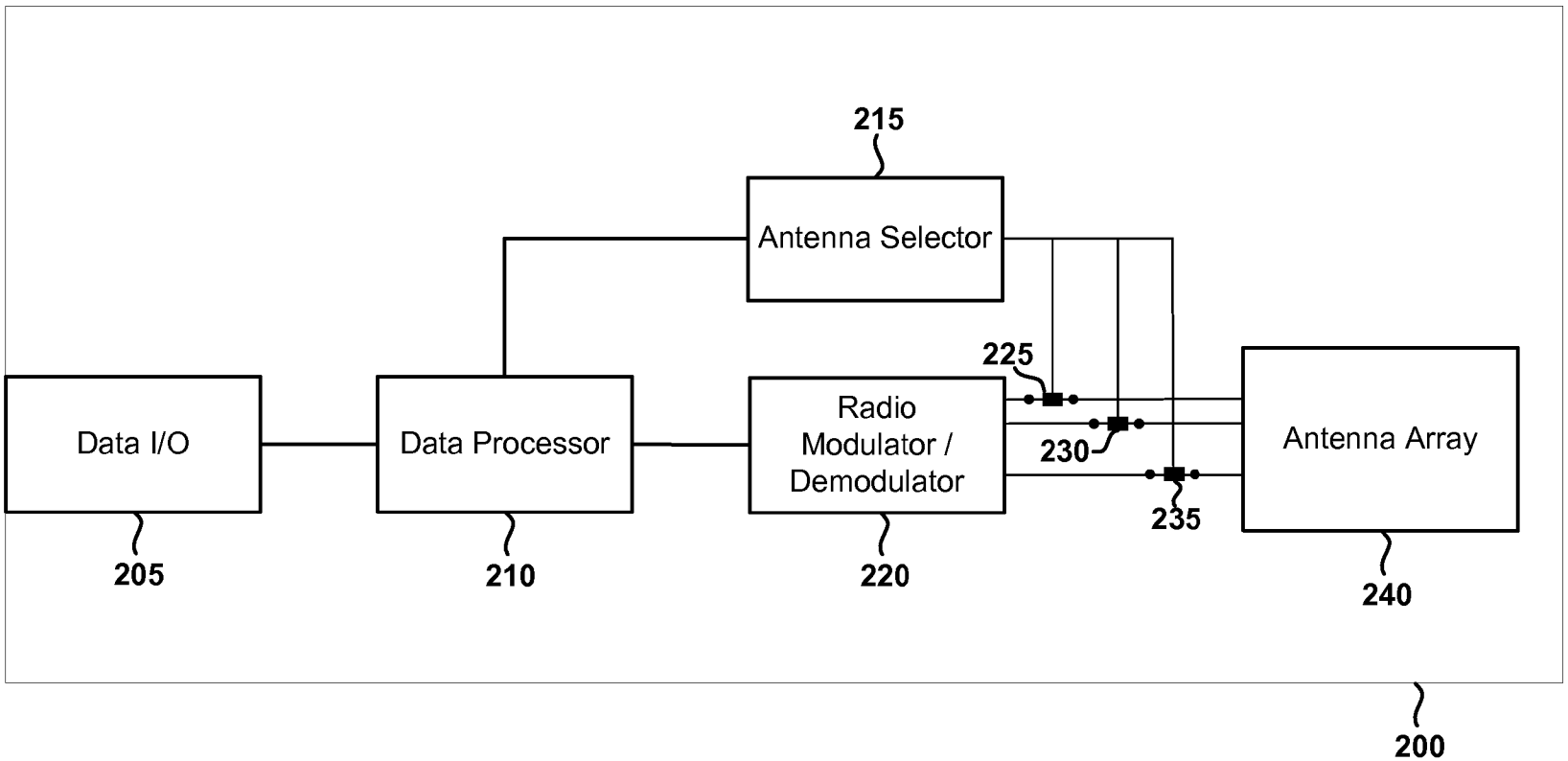
FIG. 2 a block diagram of a wireless device.

FIG. 2 is a block diagram of a wireless device 200. The wireless device 200 of FIG. 2 can be used in a fashion similar to that of wireless device 100 as shown in and described with respect to FIG. 1. The components of wireless device 200 can be implemented on one or more circuit boards. The wireless device 200 of FIG. 2 includes a data input/output (I/O) module 205, a data processor 210, radio modulator/demodulator 220, an antenna selector 215, diode switches 225, 230, 235, and antenna array 240.

The data I/O module 205 of FIG. 2 receives a data signal from an external source such as a router. The data I/O module 205 provides the signal to wireless device circuitry for wireless transmission to a remote device (e.g., nodes 110-140 of FIG. 1). The wired data signal can be processed by data processor 210 and radio modulator/demodulator 220. The processed and modulated signal may then be transmitted via one or more antenna elements within antenna array 240 as described in further detail below. The data I/O module 205 may be any combination of hardware or software operating in conjunction with hardware.

The antenna selector 215 of FIG. 2 can select one or more antenna elements within antenna array 240 to radiate the processed and modulated signal. Antenna selector 215 is connected to control one or more of diode switches 225, 230, or 235 to direct the processed data signal to one or more antenna elements within antenna array 240. The number of diode switches controlled by antenna selector 215 can be smaller or greater than the three diode switches illustrated in FIG. 2. For example, the number of diode switches controlled can correspond to the number of antenna elements and/or reflectors/directors in the antenna array 240. Antennal selector 215 may also select one or more reflectors/directors for reflecting the signal in a desired direction. Processing of a data signal and feeding the processed signal to one or more selected antenna elements is described in detail in U.S. Pat. No. 7,193,562, entitled "Circuit Board Having a Peripheral Antenna Apparatus with Selectable Antenna Elements," the disclosure of which is incorporated by reference.

Antenna array 240 can include horizontal antenna element arrays and vertical antenna element arrays. The antenna element arrays can include a horizontal antenna array and a vertical antenna array, each with two or more antenna elements. The antenna elements can be configured to operate at different frequencies concurrently such as 2.4 GHZ and 5.0 GHz. Antenna array 240 can also include a reflector/controller array.

Figure 3:
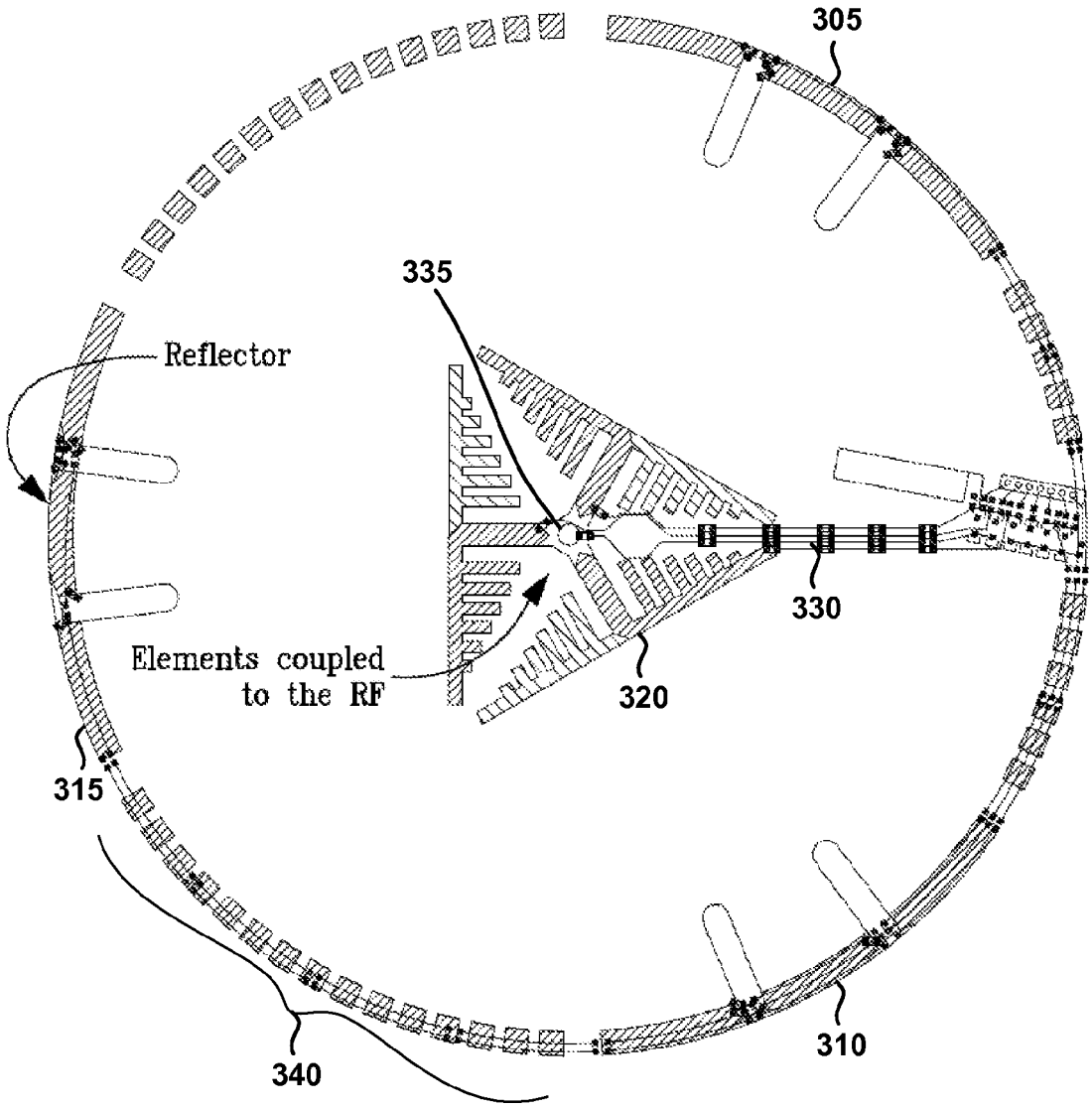
FIG. 3 illustrates a horizontal antenna array including both selectively coupled antenna elements and selectively coupled reflector/directors.

FIG. 3 illustrates an exemplary horizontal antenna array including both selectively coupled antenna elements and selectively coupled reflector/directors. The antenna array of FIG. 3 includes reflectors/directors 305, 310 and 315, horizontal antenna array 320, coupling network 330, and feed port 335. Horizontal antenna array 320 may transmit and receive an RF signal with one or more of receiving nodes 105-120. Horizontal antenna array 320 may also receive a feed RF signal through coupling network 330. Horizontal antenna array 320 is discussed in more detail with respect to FIG. 4.

The reflector/directors 305, 310 and 315 can comprise passive elements (versus an active element radiating RF energy) and be configured to constrain the directional radiation pattern of dipoles formed by antenna elements of antenna array 230. The reflector/directors can be placed on either side of the substrate (e.g., top or bottom). Additional reflector/directors (not shown) can be included to further influence the directional radiation pattern of one or more of the modified dipoles.

Each of the reflectors/directors 305, 310 and 315 can be selectively coupled to a ground component within the horizontal antenna array of FIG. 3. A reflector coupled to ground can reflect an RF signal. The radiation pattern can be constrained, directed or reflected in conjunction with portions of the ground component selectively coupled to each reflector/director. The reflector/directors (e.g., parasitic elements) can be configured such that the length of the reflector/directors may change through selective coupling of one or more reflector/directors to one another. For example, a series of interrupted and individual parasitic elements 340 that are 100 mils in length can be selectively coupled in a manner similar to the selective coupling of the aforementioned antenna elements.

By coupling together a plurality of the reflector elements, the elements may effectively become reflectors that reflect and otherwise shape and influence the RF pattern emitted by the active antenna elements (e.g., back toward a drive dipole resulting in a higher gain in that direction). RF energy emitted by an antenna array can be focused through these reflectors/directors to address particular nuances of a given wireless environment. Similarly, the parasitic elements (through decoupling) can be made effectively transparent to any emitted radiation pattern. Similar reflector systems can be implemented on other arrays (e.g., a vertically polarized array).

A similar implementation can be used with respect to a director element or series of elements that may collectively operate as a director. A director focuses energy from an RF source away from the source thereby increasing the gain of the antenna. Both reflectors and directors can be used to affect and influence the gain of the antenna structure. Implementation of the reflector/directors can occur on all antenna arrays in a wireless device, a single array, or on selected arrays.

The horizontally polarized antenna array 320 in FIG. 3 can receive signals from coupling network 330 via feed port 335. The feed port 335 is depicted as a small circle in the middle of the horizontally polarized antenna array 320. The feed port 335 can be configured to receive and transmit an RF signal to a communications device (such as receiving nodes 105-120) and a coupling network 330 for selecting one or more of the antenna elements. The RF signal can be received from, for example, an RF coaxial cable coupled to the aforementioned coupling network. The coupling network 330 can include DC blocking capacitors and active RF switches to couple the radio frequency feed port 335 to one or more of the antenna elements. The RF switches may include a PIN diode or gallium arsenide field-effect transistor (GaAs FET) or other switching devices as are known in the art. The PIN diodes may include single-pole single-throw switches to switch each antenna element either on or off (i.e., couple or decouple each of the antenna elements to the feed port 335).

Figure 4:
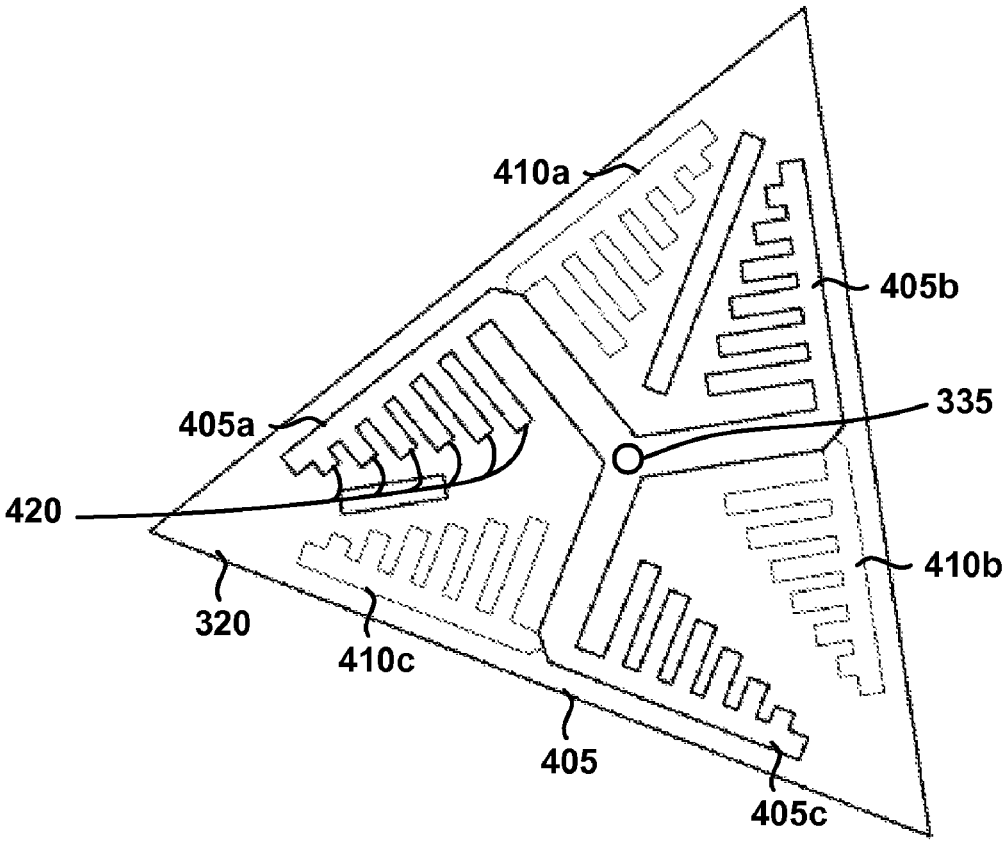
FIG. 4 illustrates a triangular configuration of a horizontally polarized antenna array with selectable elements.

FIG. 4 illustrates an exemplary horizontally polarized antenna array 320 with selectable antenna elements. The horizontally polarized antenna array has a triangular configuration which includes a substrate having a first side (solid lines 405) and a second side (dashed lines 410) that can be substantially parallel to the first side. The substrate may comprise, for example, a PCB such as FR4, Rogers 4003 or some other dielectric material.

On the first side of the substrate (solid lines 405) in FIG. 4, the antenna array 320 includes radio frequency feed port 335 selectively coupled to three antenna elements 405*a*, 405*b* and 405*c*. Although three antenna elements are depicted in FIG. 4, more or fewer antenna elements can be implemented. Further, while antenna elements 405*a*-405*c* of FIG. 4 are oriented substantially to the edges of a triangular shaped substrate, other shapes and layouts, both symmetrical and non-symmetrical, can be implemented. Furthermore, the antenna elements 405*a*-405*c* need not be of identical dimension notwithstanding such a depiction in FIG. 4.

On the second side of the substrate, depicted as dashed lines in FIG. 4, the antenna array 320 includes a ground component 410 including portions 410*a*, 410*b* and 410*c*. A portion 410*a* of the ground component 410 can be configured to form a modified dipole in conjunction with the antenna element 405*a*. Each of the ground components can be selectively coupled to a ground plane in the substrate 405 (not shown). As shown in FIG. 4, a dipole is completed for each of the antenna elements 405*a*-405*c* by respective conductive traces 410*a*-410*c* extending in mutually opposite directions. The resultant modified dipole provides a horizontally polarized directional radiation pattern (i.e., substantially in the plane of the antenna array 320).

To minimize or reduce the size of the antenna array 320, each of the modified dipoles (e.g., the antenna element 405*a* and the portion 410*a* of the ground component) may incorporate one or more loading structures 420. For clarity of illustration, only the loading structures 420 for the modified dipole formed from antenna element 405*a* and portion 410*a* are numbered in FIG. 4. By configuring loading structure 420 to slow down electrons and change the resonance of each modified dipole, the modified dipole becomes electrically shorter. In other words, at a given operating frequency, providing the loading structures 420 reduces the dimension of the modified dipole. Providing the loading structures 420 for one or more of the modified dipoles of the antenna array 320 minimizes the size of the loading structure 420.

Antenna selector 215 of FIG. 2 can be used to couple the radio frequency feed port 335 to one or more of the antenna elements within the antenna element array 320. The antenna selector 215 may include an RF switching devices, such as diode switches 225, 230, 235 of FIG. 2, a GaAs FET, or other RF switching devices to select one or more antenna elements of antenna element array 320. For the exemplary horizontal antenna array 320 illustrated in FIG. 3, the antenna element selector can include three PIN diodes, each PIN diode connecting one of the antenna elements 405*a*-405*c* (FIG. 4) to the radio frequency feed port 335. In this embodiment, the PIN diode comprises a single-pole single-throw switch to switch each antenna element either on or off (i.e., couple or decouple each of the antenna elements 405*a*-405*c* to the radio frequency feed port 335).

A series of control signals can be used to bias each PIN diode. With the PIN diode forward biased and conducting a DC current, the PIN diode switch is on, and the corresponding antenna element is selected. With the diode reverse biased, the PIN diode switch is off. In this embodiment, the radio frequency feed port 335 and the PIN diodes of the antenna element selector are on the side of the substrate with the antenna elements 405*a*-405*c*, however, other embodiments separate the radio frequency feed port 335, the antenna element selector, and the antenna elements 405*a*-405*c*.

One or more light emitting diodes (LED) (not shown) can be coupled to the antenna element selector. The LEDs function as a visual indicator of which of the antenna elements 405*a*-405*c* is on or off. In one embodiment, an LED is placed in circuit with the PIN diode so that the LED is lit when the corresponding antenna element 410 is selected.

The antenna components (e.g., the antenna elements 405*a*-405*c*, the ground component 410, and the reflector/directors directors 305, 310 and 315) are formed from RF conductive material. For example, the antenna elements 405*a*-405*c* and the ground component 410 can be formed from metal or other RF conducting material. Rather than being provided on opposing sides of the substrate as shown in FIG. 4, each antenna element 405*a*-405*c* is coplanar with the ground component 410.

The antenna components can be conformally mounted to a housing. The antenna element selector comprises a separate structure (not shown) from the antenna elements 405*a*-405*c* in such an embodiment. The antenna element selector can be mounted on a relatively small PCB, and the PCB can be electrically coupled to the antenna elements 405*a*-405*c*. In some embodiments, a switch PCB is soldered directly to the antenna elements 405*a*-405*c*.

Antenna elements 405*a*-405*c* can be selected to produce a radiation pattern that is less directional than the radiation pattern of a single antenna element. For example, selecting all of the antenna elements 405*a*-405*c* results in a substantially omnidirectional radiation pattern that has less directionality than the directional radiation pattern of a single antenna element. Similarly, selecting two or more antenna elements may result in a substantially omnidirectional radiation pattern. In this fashion, selecting a subset of the antenna elements 405*a*-405*c*, or substantially all of the antenna elements 405*a*-405*c*, may result in a substantially omnidirectional radiation pattern for the antenna array 320.

Reflector/directors 305, 310, 315 and 340 may further constrain the directional radiation pattern of one or more of the antenna elements 405*a*-405*c* in azimuth. Other benefits with respect to selectable configurations are disclosed in U.S. patent application Ser. No. 11/041,145 filed Jan. 21, 2005 and entitled "System and Method for a Minimized Antenna Apparatus with Selectable Elements," the disclosure of which is incorporated herein by reference.

Figure 5:
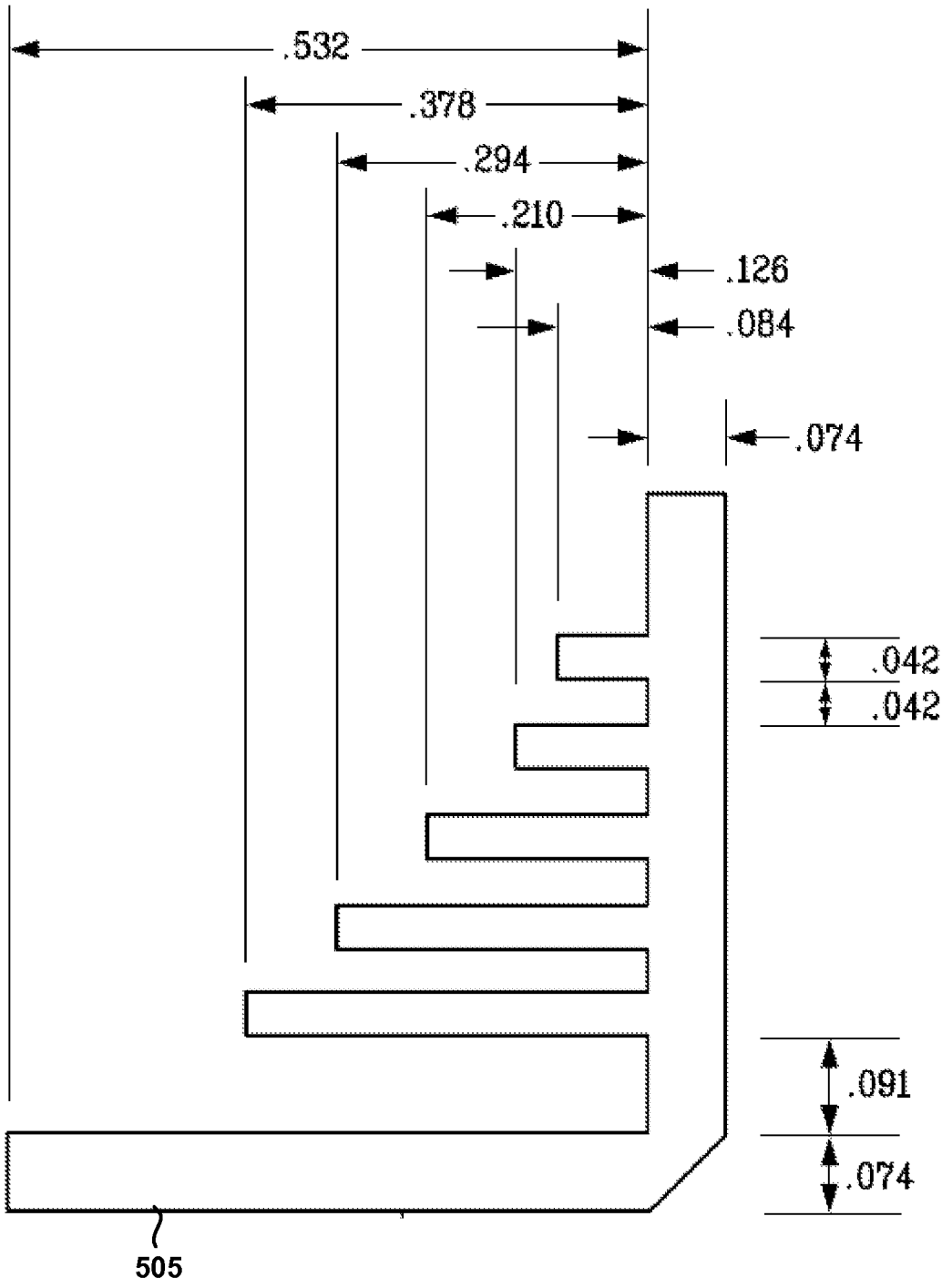
FIG. 5 illustrates a set of dimensions for one antenna element of the horizontally polarized antenna array shown in FIG. 4.

FIG. 5 illustrates an exemplary set of dimensions for one antenna element of the horizontally polarized antenna array 320 illustrated in FIGS. 3 and 4. The dimensions of individual components of the antenna array 320 (e.g., the antenna element 405*a* and the portion 410*a*) may depend upon a desired operating frequency of the antenna array 320. RF simulation software can aid in establishing the dimensions of the individual components. The antenna component dimensions of the antenna array 320 illustrated in FIG. 5 are designed for operation near 2.4 GHz based on a Rogers 3203 PCB substrate. A different substrate having different dielectric properties, such as FR4, may require different dimensions than those shown in FIG. 5, as would a substrate having an antenna element configured for operation near 5.0 GHZ.

Figure 6:
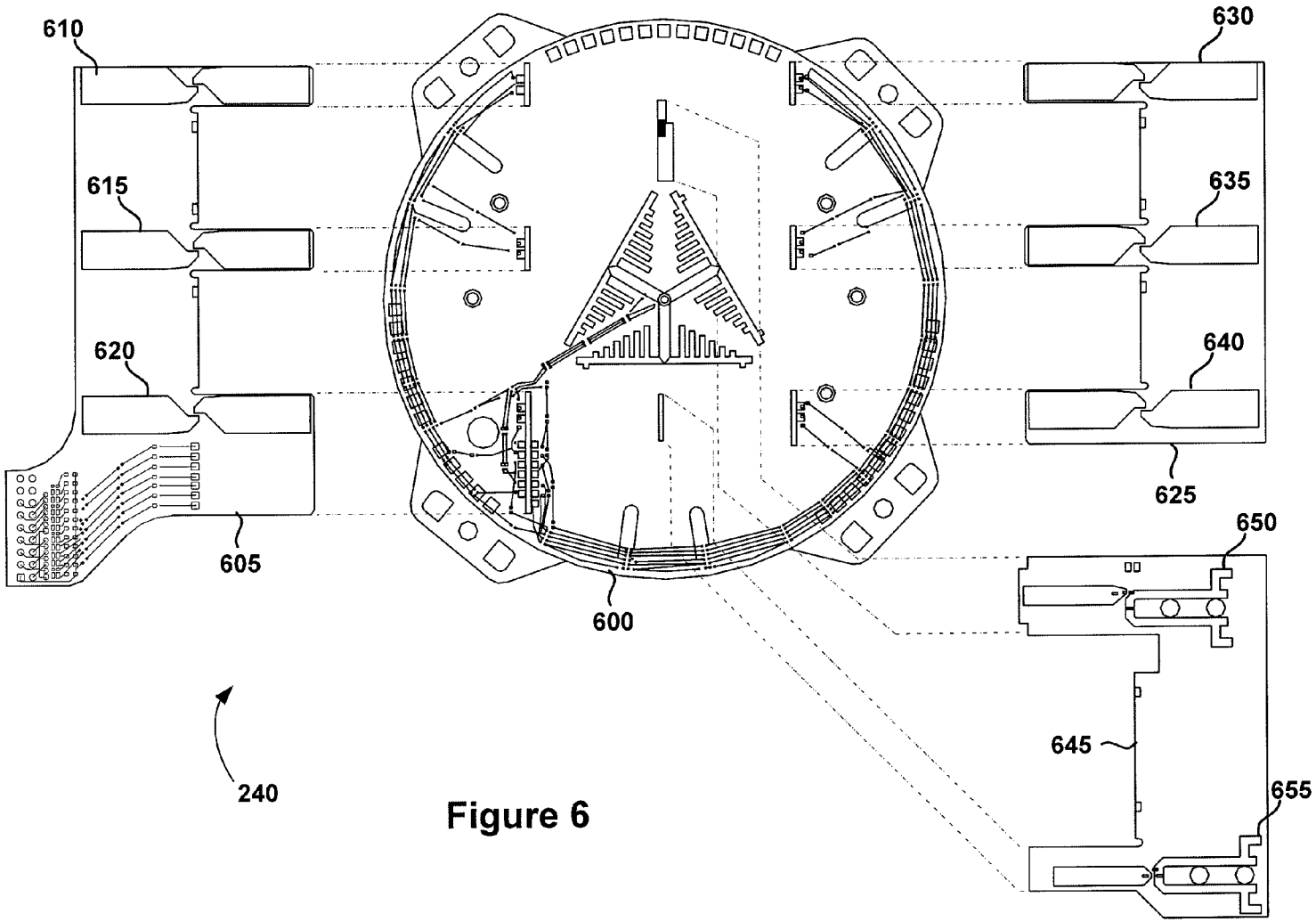
FIG. 6 illustrates an antenna array structure including a horizontal antenna array coupled to a plurality of vertical antenna arrays.

FIG. 6 illustrates an antenna structure for coupling vertical antenna arrays and reflectors/directors to a horizontal antenna array. Horizontal antenna array 600 includes a plurality of slots in a PCB for receiving antenna and reflector/director arrays. The horizontal antenna array includes two slots for receiving vertical antenna array 645, three slots for reflector/director array 605 and three slots for reflector/director array 625.

Vertical antenna array 645 includes two selectable vertical antennas 650 and 655 and can be coupled to the horizontal antenna array 600 by direct soldering at a trace, use of a jumper resistor, or some other manner. In the exemplary embodiment illustrated, the vertical antenna array 645 is coupled using slots positioned along an approximate center axis of the horizontal antenna array. Each vertical antenna is configured as an active element, is coupled to an RF feed port and can be selected using a PIN diode or other mechanism. The antenna elements of vertical antenna array 645 can operate at about 2.4 GHz.

Reflector/director array 605 includes reflectors 610, 615 and 620. Each of the reflectors/directors is passive elements and can be selected to form a connection with a ground plane portion to reflect a radiated RF signal. Reflector/director array 625 includes selectable reflectors/directors 630, 635 and 640 which operate similarly to the reflectors/directors of reflector/director array 605. Each of reflector/director arrays 605 and 625 can be coupled to the horizontal antenna array in such a position to reflect or direct RF radiation of vertical antenna array 645.

As illustrated in the exemplary embodiment of FIG. 6, the reflectors/director arrays can be positioned around the vertical antenna array 645 to reflect or direct radiation in a desired direction. The number of reflectors/directors used in a particular array, as well as the number of reflector/director arrays coupled to horizontal antenna array 600, may vary.

Figure 7:
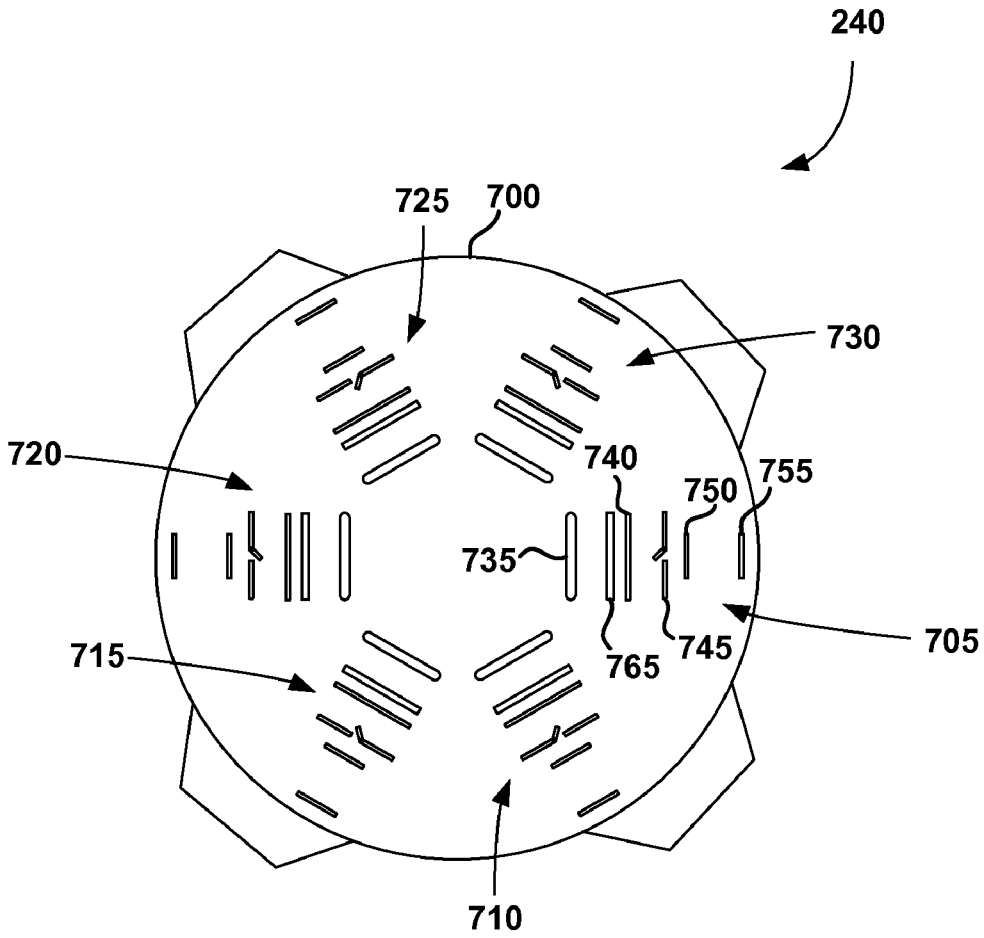
FIG. 7 illustrates a horizontal antenna array having dual band horizontal antenna elements within a PCB board.
Figure 8:
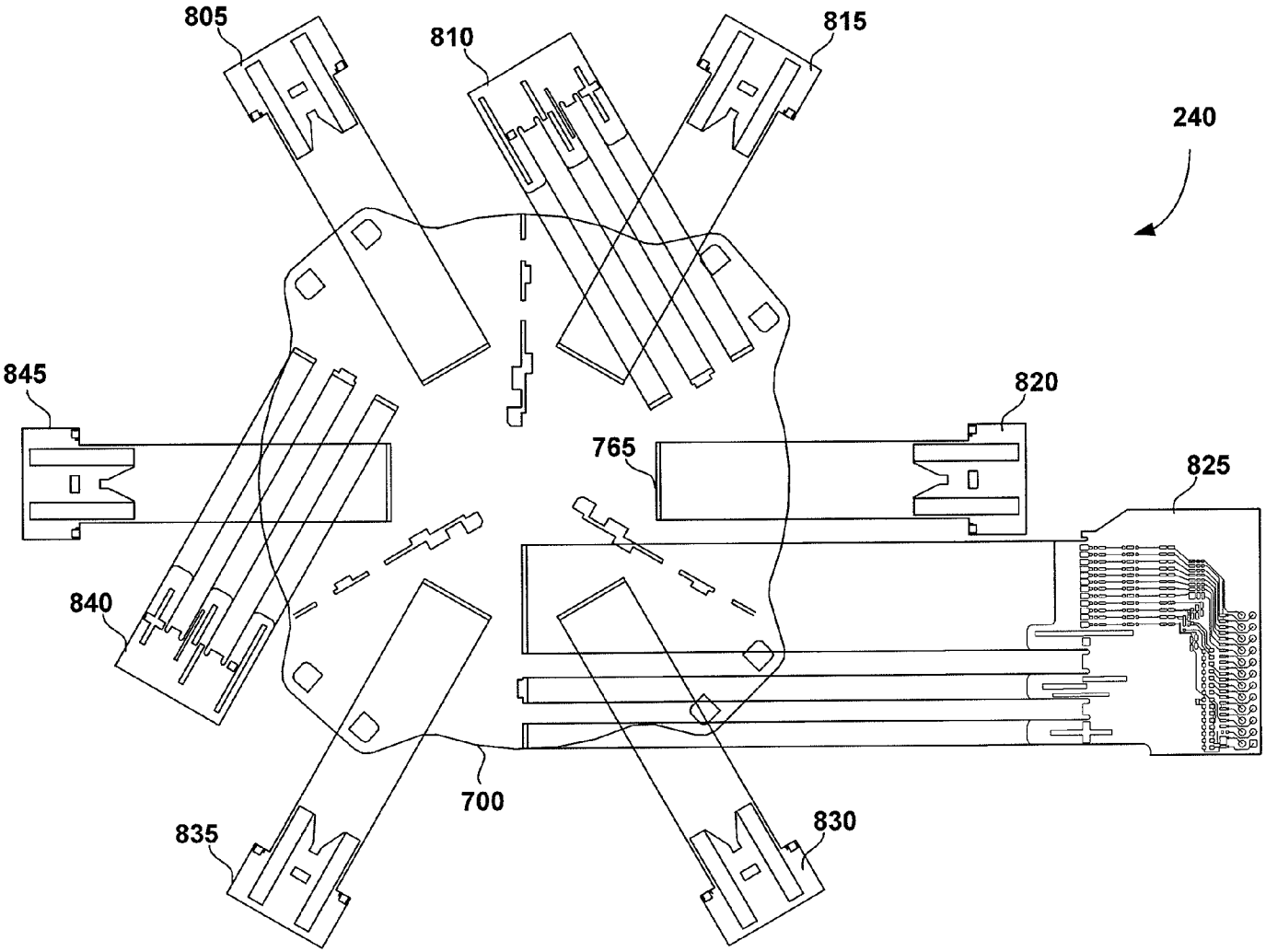
FIG. 8 illustrates a horizontal antenna array coupled to a plurality of high band vertical antenna arrays.
Figure 9:
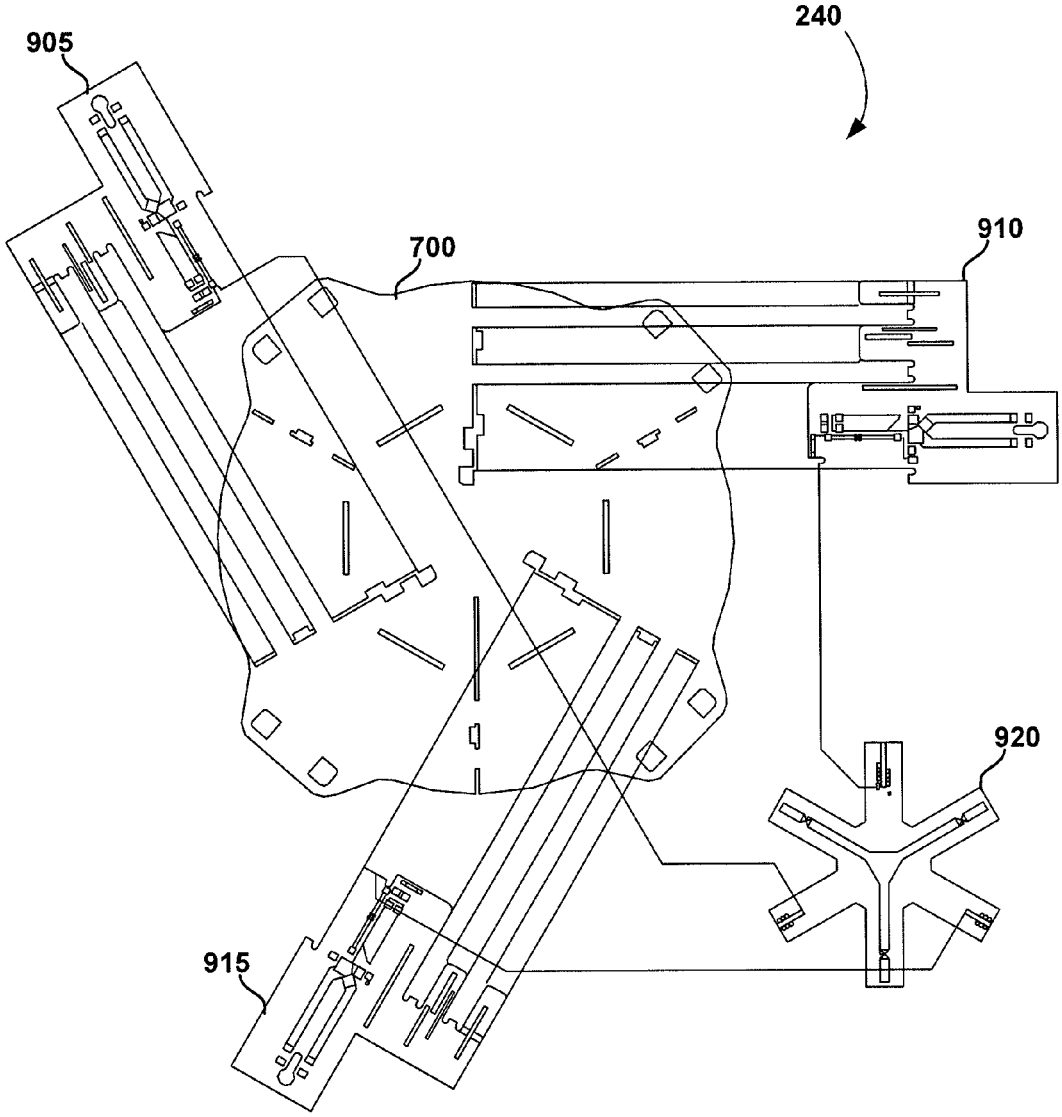
FIG. 9 illustrates a horizontal antenna array coupled to a plurality of low band vertical antenna arrays.

FIGS. 7-9 illustrate an exemplary antenna array configured to concurrently operate with horizontal and vertical polarization with omnidirectional radiation in multiple frequency bands. Various arrays illustrated in FIGS. 7-9 can be coupled to one another through a combination of insertion of the arrays through various PCB feed slits or apertures and soldering/jumping feed traces at intersecting trace elements.

FIG. 7 illustrates an exemplary horizontal antenna array 700 having dual band horizontal antenna elements within a PCB board. The horizontal antenna array includes antenna elements sets 705, 710, 715, 720, 725 and 730. Each antenna element set can be spaced apart equally along the horizontal antenna array, such as sixty degrees apart for six antenna sets. One or more antenna element sets can also be spaced apart unequally across the horizontal antenna array 700.

Each antenna set in exemplary horizontal antenna array 700 can include one or more antenna elements that operate at 2.4 GHz, one or more antenna elements that operate at 5.0 GHz, and one or more passive reflector/director elements. In antenna element set 705, selectable antenna elements 735 may operate at 2.4 GHz and selectable antenna element 745 may operate at 2.4 GHz. Selectable element 740 can form a dipole with element 725 and selectable element 750 can form a dipole with element 745. Each of selectable elements 740 and 750 are passive elements that can be connected to ground. Selectable element 755 is passive element which can be connected to ground for use as a reflector/director.

Only the antenna elements, ground portions and reflector of antenna set 705 are labeled in the horizontal antenna array 700 for purposes of clarity of instruction. Each antenna set of horizontal antenna array 700 may include the labeled components of antenna set 705 or additional or fewer components (e.g., antenna elements, dipole ground elements, and reflectors/directors).

The horizontal antenna elements can be positioned on the horizontal antenna array 700 such that antenna elements that operate at 2.4 GHz are positioned on the inside (closer to the center of the PCB) of antenna elements that operate at 5.0 GHz. The antenna elements which radiate at 2.4 GHz can degrade the radiation signal of the 5.0 GHz antenna elements when the 2.4 GHz antenna elements are in the desired path of the radiation produced by the 5.0 GHz antenna elements. The smaller 5.0 GHz antenna elements have a negligible effect on the radiation of the 2.4 GHz antenna elements. Hence, when radiation is configured to go outward along the plane of the horizontal antenna array PCB, the 2.4 GHz antenna elements (dipole elements 735 and 740 in FIG. 7) will not affect the 5.0 GHz radiation as long as the 2.4 GHz antenna elements are positioned behind the 5.0 GHz antenna elements (dipole elements 745 and 750 in FIG. 7).

Each antenna element within an antenna element array set can be coupled to a switch such that the antenna elements which operate at about 2.4 GHz and about 5.0 GHz can radiate concurrently. Antenna elements within multiple antenna sets can also be configured to operate simultaneously, such as opposing antenna sets 705 and 720, 710 and 725, and 715 and 730.

Horizontal antenna array 700 can be coupled to one or more vertical antenna arrays. The vertical antenna arrays can couple to one or more slits or apertures within the horizontal antenna array, wherein the slits or apertures can be positioned in various positions on the horizontal antenna array PCB board. The horizontal antenna array may include slits or apertures for receiving vertical antenna arrays that operate at 5.0 GHz, vertical antenna arrays that operate at 2.4 GHz, reflectors and directors, or a combination of these. Slits such as 765 in set 705 in FIG. 7 may receive an array of vertical reflectors. Additional slits and the arrays coupled to the horizontal antenna array 700 are discussed in more detail below.

FIG. 8 illustrates an exemplary embodiment of horizontal antenna array 700 coupled to a plurality of high band vertical antenna arrays. Horizontal antenna array 700 has slits for coupling to vertical antenna arrays 810, 825 and 840 and reflector/director arrays 805, 815, 820, 830, 835, and 845. Vertical antenna arrays 810, 825 and 840 as illustrated are configured to operate at about 5.0 GHz and couple to horizontal antenna array 700 through slits spaced about one hundred twenty degrees apart. More or fewer than three vertical antenna arrays can be coupled to horizontal antenna array 700, each of which can be spaced evenly or unevenly around horizontal antenna array 700.

Reflector/director arrays 805, 815, 820, 830, 835, and 845 couple with horizontal antenna array 700 through slits as shown in FIG. 8. Each reflector/director array 805, 815, 820, 830, 835, and 845 includes two passive selectable reflector/directors. The reflector/director arrays 805, 815, 820, 830, 835, and 845 as illustrated can be evenly spaced at about sixty degrees. More or fewer reflector/director arrays can be coupled to horizontal antenna array 700, each of which can be spaced evenly or unevenly around horizontal antenna array 700.

FIG. 9 illustrates an exemplary embodiment of a horizontal antenna array coupled to a plurality of low band vertical antenna arrays. Horizontal antenna array 700 in FIG. 9 has slits for coupling to vertical antenna arrays 905, 910, and 915. Vertical antenna arrays 905, 910, and 915 as illustrated in FIG. 9 each include an antenna element configured to operate at about 2.4 GHz and are collectively spaced about one hundred twenty degrees apart. More or fewer 2.4 GHz vertical antenna arrays can be coupled to horizontal antenna array 700, each of which can be spaced evenly or unevenly around horizontal antenna array 700.

The 2.4 GHz vertical antenna arrays 905, 910, and 915 can be spaced on horizontal antenna array 700 between the 5.0 GHz vertical antenna arrays 810, 825 and 840, for example in an alternating order and spaced apart from the 5.0 GHz vertical antenna arrays by sixty degrees. For example, 5.0 GHz antenna array 815 can be coupled to horizontal antenna array 700 between 2.4 GHz antenna arrays 910 and 915 and directly across from 2.4 GHz antenna array 905.

The vertical antenna arrays 905, 910 and 915 may couple to a position-sensing element 920. The position sensing element 920 may determine the orientation of wireless device 105 as well as detect when the position of the wireless device 105 changes. In response to detecting the position of movement of wireless device 105, radiation patterns of the wireless device can be adjusted. A wireless device with a position sensor and adjustment of radiation patterns based on the position sensor are disclosed in U.S. patent application Ser. No. 12/404,127 filed Mar. 13, 2009 and entitled "Adjustment of Radiation Patterns Utilizing a Position Sensor," the disclosure of which is incorporated herein by reference.

Wireless device 105 with a horizontal antenna array 700 and the vertical arrays illustrated in FIGS. 8-9 can concurrently radiate a horizontally polarized signal as well as a vertically polarized signal at both about 2.4 GHz and about 5.0 GHz (dual polarization and dual band operation). During dual polarization and dual band operation, different combinations of antenna elements can be selected, for example using switches. The switches may couple several antenna elements together to operate simultaneously. One or more single-pole single-throw four way switches can be used to couple groups of opposing vertical antenna arrays and a pair of opposing horizontal antenna arrays which are aligned perpendicular to the opposing vertical antenna arrays.

With respect to the antenna arrays of FIGS. 7-9, a four-way switch can be coupled to horizontal antenna sets 720 and 735, 2.4 GHz antenna array 910 and 5.0 GHz antenna array 825. Another four-way switch can be coupled to horizontal antenna sets 725 and 710, 2.4 GHz antenna array 905 and 5.0 GHz antenna array 810. Yet another four-way switch can be coupled to horizontal antenna sets 715 and 720, 2.4 GHz antenna array 915 and 5.0 GHz antenna array 840.

The antenna array 240 can be a dual polarized, multiple frequency, high-gain, omnidirectional antenna system. While perpendicular horizontal and vertical antenna arrays are disclosed, it is not necessary that the various arrays be perpendicular to one another along a particular axis (e.g., at a 90 degree intersection). Various array configurations are envisioned in the practice of the presently disclosed invention. For example, a vertical array can be coupled to another antenna array positioned at a 45 degree angle with respect to the vertical array. Utilizing various intersection angles with respect to the two or more arrays may further allow for the shaping of a particular RF emission pattern.

A different radio can be coupled to each of the different polarizations. The radiation patterns generated by the varying arrays (e.g., vertical with respect to horizontal) can be substantially similar with respect to a particular RF emission pattern. Alternatively, the radiation patterns generated by the horizontal and the vertical array can be substantially dissimilar versus one another.

An intermediate component can be introduced at a trace element interconnect of an antenna array such as a zero Ohm resistor jumper. The zero Ohm resistor jumper effectively operates as a wire link that can be easier to manage with respect to size, particular antenna array positioning and configuration and, further, with respect to costs that can be incurred during the manufacturing process versus. Direct soldering of the traces may also occur. The coupling of the two (or more) arrays via traces may allow for an RF feed to traverse two disparate arrays. For example, the RF feed may 'jump' the horizontally polarized array to the vertically polarized array. Such 'jumping' may occur in the context of various intermediate elements including a zero Ohm resistor and/or a connector tab as discussed herein.

The embodiments disclosed herein are illustrative. Various modifications or adaptations of the structures and methods described herein can become apparent to those skilled in the art. For example, embodiments of the present invention can be used with respect to MIMO wireless technologies that use multiple antennas as the transmitter and/or receiver to produce significant capacity gains over single-input and single-output (SISO) systems using the same bandwidth and transmit power. Such modifications, adaptations, and/or variations that rely upon the teachings of the present disclosure and through which these teachings have advanced the art are considered to be within the spirit and scope of the present invention. Hence, the descriptions and drawings herein should be limited by reference to the specific limitations set forth in the claims appended hereto.

The embodiments disclosed herein are illustrative. Various modifications or adaptations of the structures and methods described herein can become apparent to those skilled in the art. Such modifications, adaptations, and/or variations that rely upon the teachings of the present disclosure and through which these teachings have advanced the art are considered to be within the spirit and scope of the present invention. Hence, the descriptions and drawings herein should be limited by reference to the specific limitations set forth in the claims appended hereto.

What is claimed is:

1. A dual band antenna system, comprising:

a horizontally polarized antenna array that concurrently operates at a first frequency and a second frequency; and a vertically polarized antenna array coupled to the horizontally polarized antenna array and that concurrently operates at the first frequency and the second frequency with the horizontally polarized antenna array; and a radio modulator/demodulator that communicates a radio frequency signal with the horizontally polarized antenna array and vertically polarized antenna array.

2. The dual band antenna system of claim 1, wherein the first frequency is higher than the second frequency, and the horizontally polarized antenna array includes a first antenna positioned outside of the radiation produced by a second antenna in the horizontally polarized antenna array.

3. The dual band antenna system of claim 2, wherein the first antenna element operates at about 2.4 GHz and the second antenna element operates at about 5.0 GHz.

4. The dual band antenna system of claim 2, wherein the first antenna element and the second antenna element are on a single printed circuit board.

5. The dual band antenna system of claim 1, wherein the horizontally polarized antenna array includes a first antenna element that operates at the first frequency and a second antenna element that operates at the second frequency.

6. The dual band antenna system of claim 1, wherein a circuit board hosting the vertically polarized array couples with a circuit board hosting the horizontally polarized array through a slit in the circuit board hosting the horizontally polarized array.

7. The dual band antenna system of claim 1, wherein the vertically polarized array includes a first vertical antenna element array having a first antenna element that operates at the first frequency and a second vertical antenna element array having a second antenna element that operates at the second frequency.

8. The dual band antenna system of claim 7, wherein the first vertical antenna element array and second vertical antenna element array are equally spaced around the horizontal antenna array.

9. The dual band antenna system of claim 1, wherein the first vertical antenna element array and second vertical antenna element array are alternatively positioned around the horizontal antenna array.

10. The dual band antenna system of claim 1, further comprising an antenna that selectively couples antenna elements within the horizontally polarized array and vertically polarized array.

11. The dual band antenna system of claim 1, further comprising a reflector that reflects a radiation pattern of the horizontally polarized antenna array or vertically polarized antenna array.

* * * * *